US006657553B1

(12) United States Patent
Bergman et al.

(10) Patent No.: US 6,657,553 B1
(45) Date of Patent: Dec. 2, 2003

(54) METHOD OF MONITORING A PROTECTED SPACE

(75) Inventors: Robert L. Bergman, Murfreesboro, TN (US); David M. White, Murfreesboro, TN (US)

(73) Assignee: Titan Specialized Services, Inc., Murfreesboro, TN (US)

( * ) Notice: Subject to any disclaimer, the term of this patent is extended or adjusted under 35 U.S.C. 154(b) by 381 days.

(21) Appl. No.: 09/626,038

(22) Filed: Jul. 27, 2000

(51) Int. Cl.[7] ..... G08C 19/10

(52) U.S. Cl. ..... 340/870.11; 340/870.07; 340/541; 348/143; 725/93

(58) Field of Search ..... 340/870.11, 870.07, 340/540, 541, 545.2, 430; 348/143, 155; 725/105, 93, 116, 146

(56) References Cited

U.S. PATENT DOCUMENTS 6,476,858 B1 * 11/2002 Ramirez Diaz et al. .... 348/159

2002/0147982 A1 * 10/2002 Naidoo et al. ..... 725/105

* cited by examiner

*Primary Examiner*—Timothy Edwards
(74) *Attorney, Agent, or Firm*—Welsh & Katz, Ltd.

(57) ABSTRACT

A method and apparatus are provided for collecting and disseminating information regarding a protected space. The method includes the steps of detecting a signal event of the protected space, coding the signal event into a packet message and transferring the coded packet message to a database through an internet connection between the protected space and the database. The method further includes the steps of storing the coded message packet in a secure storage area of the database under a password assigned to a manager of the protected space and providing access to information of the coded message packet through an Internet connection between the manager and the database based upon the password assigned to the manager.

36 Claims, 2 Drawing Sheets

METHOD OF MONITORING A PROTECTED SPACE

FIELD OF THE INVENTION

The field of the invention relates to protected spaces and more particularly to the monitoring of such spaces.

BACKGROUND OF THE INVENTION

Protected spaces such as computer rooms are well known. Such areas are characterized by a high asset value, a low level of human occupancy and a critical need for a stable operating environment.

In order to maintain the needed stable operating environment, such spaces are often equipped with extensive alarm systems and central station monitoring. Central stations are typically monitored twenty-four hours a day, seven days a week.

The monitoring typically consists of set-point sensors (e.g., thermostats, humidistats, etc.) hardwired to the central station. Often the triggering of an alarm requires alerting some responsible party. Alerting a responsible party typically involves sequentially dialing telephone numbers of designated parties from a call list. Often the first to answer the telephone call is charged with investigating the cause for the alarm.

While such systems are effective, they often malfunction. Sensors function when they shouldn't or fail to function when they should, often resulting in significant damage to the equipment within the protected space. Because of the importance of the equipment within protected spaces a need exists for a more reliable method of monitoring such spaces.

SUMMARY

A method and apparatus are provided for collecting and disseminating information regarding a protected space. The method includes the steps of detecting a signal event of the protected space, coding the signal event into a packet message and transferring the coded packet message to a database through an internet connection between the protected space and the database. The method further includes the steps of storing the coded message packet in a secure storage area of the database under a password assigned to a manager of the protected space and providing access to information of the coded message packet through an Internet connection between the manager and the database based upon the password assigned to the manager.

DETAILED DESCRIPTION OF A PREFERRED EMBODIMENT

Figure 1:
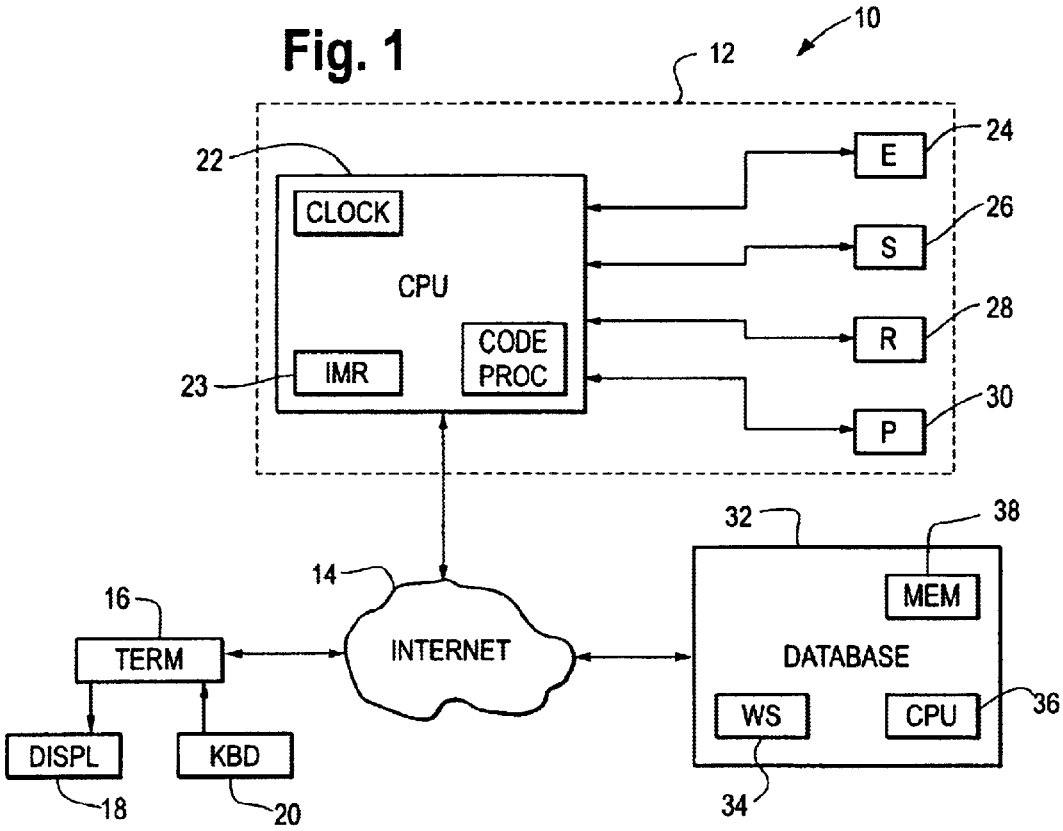
FIG. 1 is a block diagram of a system for monitoring a protected space in accordance with an illustrated embodiment of the invention.

FIG. 1 is a block diagram of a monitoring system 10, shown generally under an illustrated embodiment of the invention. As shown, one or more data collection central processing units (CPUs) 22 may be located within the protected space 12 monitoring an operating environment of the space 12 through one or more sensors 24, 26, 28, 30.

The CPU 22 may be any appropriate processor (e.g., a Pentium III) using an appropriate software (e.g., Bridgeview run-time software). The sensors 24, 26, 28, 30 may include any appropriate sensor technology (e.g., network power meters and network environmental sensors obtained from Veris Industries, Inc.). The sensors 24, 26, 28, 30 may be connected to the CPU 22 using appropriate hardware (e.g., networked digital input modules obtained from Busware Direct) and an appropriate protocol (e.g., modbus rtu protocol operating under the RS-485 standard).

Periodically, or upon the occurrence of a predetermined event, the data collection CPU 22 (acting as a coding processor) may compose a packet message for transfer to a database 32. The database 32 may rely upon custom software developed using Bridgeview Developers Package. The database 32 may collect information from a number of CPUs 22 in a number of different protected spaces 12 and store the information in a database, which could be Microsoft SQL Server, Oracle, or mySQL.

The packet message may include at least an Internet address of the database 32, an identifier of the originating data collection CPU 22 and information concerning the one or more sensors 24, 26, 28, 30. The information concerning the one or more sensors may include an identifier of the type of information as well as a field of data.

Figure 2:
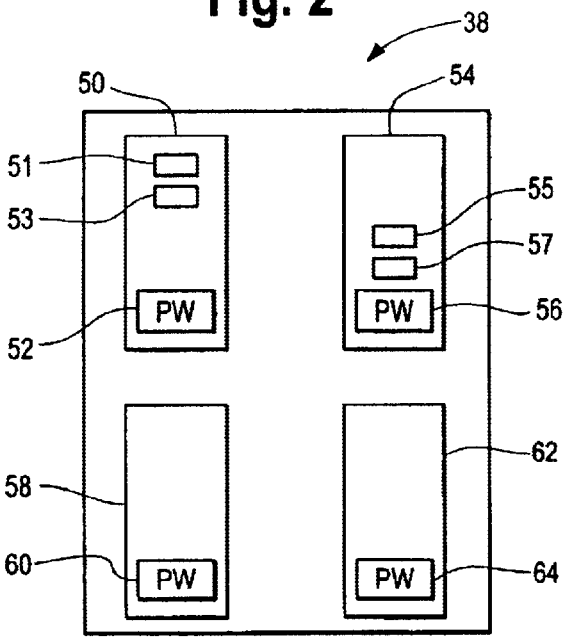
FIG. 2 depicts a memory that may be used by the system of FIG. 1.

The database 32 upon receiving the packet first decodes the packet to recover an identifier of the sending CPU 22. With the identifier of the sending CPU 22, the database is able to identify a storage location 50, 54, 58, 62 (FIG. 2) within a memory 38 of the database 32.

Under the illustrated embodiment, each collection CPU 22 is allocated a specific area 50, 54, 58, 62 of memory 38 for the storage of sensor data. Associated with each storage area 50, 54, 58, 62 is a password 52, 56, 60, 64. Associating a password 52, 56, 60, 64 with each storage space 50, 54, 58, 62 allows access to the data to be limited to a specific manager with responsibility for maintaining the space 12.

Associated with the database 32 may be a data dissemination server (e.g., a CPU 36) supporting a website 34. The server 36 may be a Pentium III based server running either Microsoft Windows 2000 IIS4 software or Slackware Linux with Apache Web Server. A custom user interface may be used to accept a user login and based upon that login display available data in either real-time or in a historical trending mode.

Figure 3:
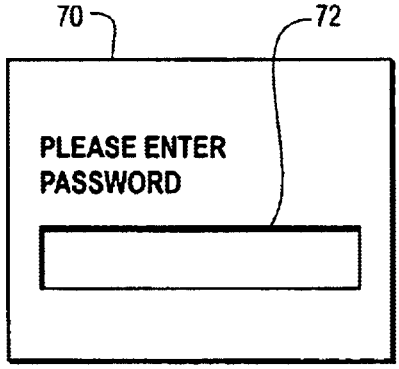
FIG. 3 depicts a screen that may be display by the system of FIG. 1.

To access the data concerning a particular space, a responsible manager may access the website 34 using a terminal 16 with a web browser. A sign-on screen 70 (FIG. 3) may be presented to the manager. Within the sign-on screen 70 an interactive window 72 may be provided for entry of a password 52, 56, 60, 64.

Figure 4:
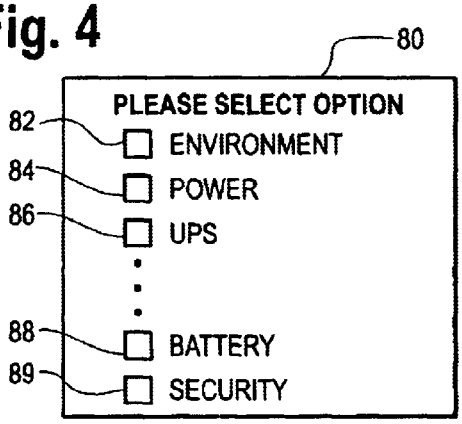
FIG. 4 depicts another screen that may be displayed by the system of FIG. 1.

Upon the proper entry of his password 52, 56, 60, 64, the manager may be allowed access to the information stored within his memory space 50, 54, 58 62. To facilitate the presentation of information, the manager may be presented with a series of menu selections 82, 84, 86, 88 (FIG. 4). By activation of appropriate menu selections 82, 84, 86, 88, the manager may be provided with full access to a complete selection of information collected regarding the space 12 from anywhere in the world. Collected information may be viewed in real-time or over selected time intervals.

Turning now to the space 12, a more detailed description will be provided of the sensors 24, 26, 28, 30 and collection CPU 22. Following the description of the sensors 24, 26, 28, 30 and CPU 22, a detailed description will be provided of the database 32 and the processing of information stored within the database. Finally, examples will be provided of information available to a manager through the website 34.

The sensors 24, 26, 28, 30 may monitor and measure any of a number of parameters within the space. For example, a first set of sensors 24 may detect environmental factors. The sensor 24 may monitor temperature, humidity, air conditioner or heater operation. Moisture detectors may be monitored. Carbon monoxide and/or carbon dioxide may be measured. The condition of air makeup blowers or air conditioning compressors may be monitored for failures.

Monitoring may be based upon any number of trigger points. In the case of temperature, a deviation in a temperature by a predetermined percentage may trigger an event. Alternatively, a timer 23 within the CPU 22 may trigger a temperature measurement. Alternately, a contact closure indicating a motor failure may be used to trigger an event.

Another group of sensors 26 may be provided for security. The sensors 26 may be door switches, motion detectors or any other intrusion detector. The sensor 26 may also be a video camera using to transfer images at a relatively low frame rate.

A third group of sensors 28 may provide information regarding an uninterruptable power supply (UPS) system as well as batteries powering the UPS. Dry contact closure may be detected regarding alarms. A voltage (e.g., phase to phase, phase to neutral, etc.) may be measured regarding UPS operation. A power output (e.g., kWH, kW, kVA, etc.) of the USP may be measured. A power factor of the voltage and current (i.e., for each phase or all three phases) may be measured. Power demand may be measured.

Where the UPS is powered by an internal combustion engine, a voltage of a cranking motor may be measured and reported. Engine block and coolant temperature may be monitored and reported. Fuel levels may be monitored and reported.

Battery voltage of each battery of the UPS system may be monitored to determine a charge level. Battery current may be measured to determine a discharge rate. Battery temperature may be measured to track factors which may affect battery life. Each battery parameter may be reported and stored in the database 32 under an identifier of the battery.

When the UPS is in an inactive state, ripple, charge and float currents may be monitored. Battery charger, rectifier and load status may be monitored. A cell/bloc impedance of each battery may be determined and reported along with other monitored parameters.

A fourth group of sensors 30 may be provided to monitor power entering the space 12. Voltage may be measured for dwell, dips and drop. Total harmonic distortion (THD) on supply mains may be measured. Harmonics on the power system to the 50th magnitude may be measured as well as voltage imbalances among phase connections. A power factor and/or the THD of the voltage and current may be periodically measured for purposes of negotiating utility rates with a power company. Flicker, PST and PLT based upon the CEI 868 and CEI 1000-4-15 standards may be measured.

The collecting CPU 22 may correlate measured events to further determine status factors. For example, in the case of battery data, the CPU 22 may calculate a discharge time remaining under a current discharge rate. A depth of discharge may be tracked by integrating discharge rates. A performance index may be determined by tracking discharge rates. A battery life expectancy may be estimated from voltage and current, performance index and battery temperatures.

With regard to power monitoring, the CPU 22 may determine an average power demand as well as maximum and minimum demand from measured values. Similarly, maximum and minimum power factors may be correlated to a time of day. Locally generated data for battery and power. monitoring may be reported under an appropriate format.

Figure 5:
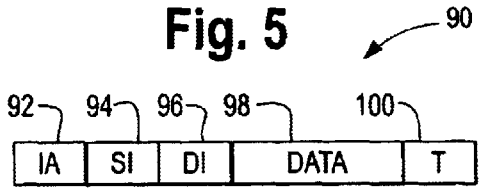
FIG. 5 depicts a packet message that may be used by the system of FIG. 1.

Periodically, or based upon the nature of the monitored information, the CPU 22 may compose a packet message 90 (FIG. 5) for transmission to the database 32. The packet 90 may include an Internet address 92 and a source identifier 94. The Internet address 92 identifies the database 32. The source identifier 94 identifies the CPU 22.

Also included within the packet 90 may be a data identifier 96. The data identifier 96 may be an identifier of the type of information. It may identify the data 98 as being a current or a voltage. It may also identify a battery as being the source of the current. Where the current is a utility connection the data identifier 96 may identify the connection.

Associated with the data 98 may be a time stamp provided by a clock within the CPU 22. The time stamp may be used to identify a time period when the data was collected. Alternatively, where the data 98 deals with averages, the time stamp may identify a time interval over which the data was collected.

Upon receipt of the packet 90, the database 32 first identifies the memory area 50, 54, 58, 62 reserved for the space 12 and then a subarea 51, 53 reserved for the type of data involved. For example, one area (e.g., 51) may be reserved for voltage measurements. Another area 53 may be reserved for current.

Upon accessing the website 34, the manager working through a terminal 16 may enter a password 52, 56, 60, 64 through the window 72 using a keyboard 20 and be granted access. Upon being granted access, the manager may view the menu 80 activate a softkey 82, 84, 86, 88, 89 of an area of interest (e.g., the POWER softkey 84.

Figure 6:
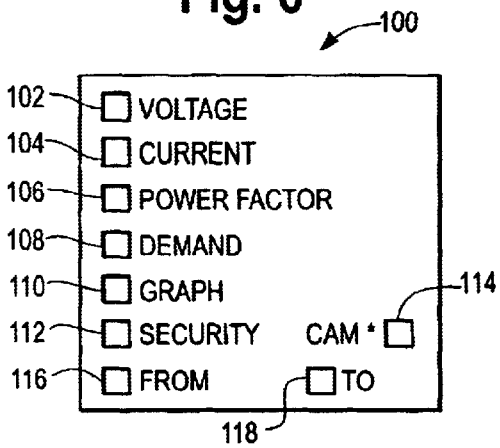
FIG. 6 depicts another screen that may be displayed by the system of FIG. 1.

Upon activating the POWER softkey 84, a parameter select screen 100 (FIG. 6) may be presented to the manager. The manager may select from any of a number of relevant factors, such as voltage 102, current 104, power factor 106 or demand 108. Upon selection of a particular parameter (e.g., voltage 102), the data may be presented in tabular form along with a time of detection, with the most recent value presented first.

A set of selection windows 116, 118 may be provided for selection of data. Using the selection windows 116, 118, the manager may select a time interval for data viewing.

Figure 7:
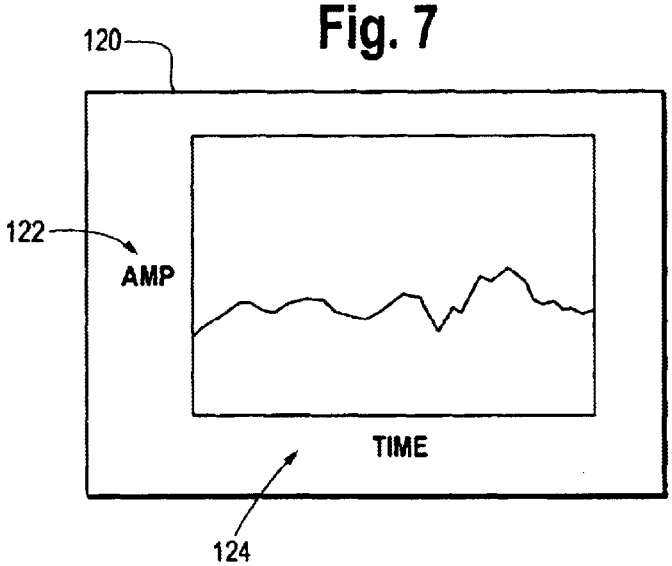
FIG. 7 depicts a graph that may be prepared by the system of FIG. 1.

The manager may also choose to have the data graphed. To graph data, the manager first selects a parameter by activation of an appropriate softkey 102, 104, 106, 108 and selects the GRAPH softkey 110. In response a CPU 36 within the database 32 may graph and present the data within a window 120 in terms of amplitude 122 and time 124 (FIG. 7).

Alternatively, where a security softkey 89 (FIG. 4) is selected, the graphics displayed within the window 120 may include a physical layout of the protected space 12. Displayed within the window 120 may be an indication of each security sensor as well as a graphical indication of any activated sensors.

Alternatively, the manager may enter a camera identifier in a window 114. By identifying a camera, visual images may be displayed in the window 120.

Under another illustrated embodiment, the spaces 50, 54, 58, 62 may contain a set of threshold values for each measured parameter. During operation, the CPU 36 continuously compares received parameters against corresponding threshold values. When a received value exceeds a threshold, the CPU 36 may compose and send an e-mail message to the managers terminal 16 notifying the manager of the condition. The manager may then log onto the website 34 and retrieve additional data regarding the source of the detected condition. By retrieving an analyzing the data from a remote location, the manager may be able to determine whether the detected condition is sufficient to require immediate attention or of a minor nature that may be corrected in the normal course of events.

A specific embodiment of a method and apparatus for monitoring a protected space according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed is:

1. A method of collecting and disseminating information regarding a plurality of protected spaces comprising the steps of:

providing a database with a plurality of secure storage areas where each secure storage area of the plurality of secure storage areas is reserved for a respective protected space of the plurality of protected spaces;

reserving a subarea of each secure storage area of the database for each type of data received from the protected spaces;

detecting a signal event of a protected space of the plurality of protected spaces, where such signal event is not from a security sensor and is not a video signal;

coding the signal event into a packet message;

transferring the coded packet message to the database through an internet connection between the protected space and the database;

determining a type of signal event of the packet message storing the coded message packet in a secure storage area and subarea of the plurality of secure storage areas of the database that corresponds to the protected space and type of signal event of the protected space under a password assigned to a manager of the protected space; and providing access to information of the coded message packet through an Internet connection between the manager and the database based upon the password assigned to the manager.

2. The method of collecting and disseminating information as in claim 1 further comprising associating a time stamp with the coded signal event.

3. The method of collecting and disseminating information as in claim 1 further comprising associating a source indicator with the signal event.

4. The method of collecting and disseminating information as in claim 1 further comprising receiving the password assigned to the manager from the manager of the protected space by a controller of the database.

5. The method of collecting and disseminating information as in claim 1 wherein the step of receiving the password further comprises presenting the manager with a menu of information display options of information contained within the secure storage area.

6. The method of collecting and disseminating information as in claim 1 further comprising defining the message event as information related to a status of an emergency power system protecting the protected space.

7. The method of collecting and disseminating information as in claim 1 further comprising defining the message event as environmental data related to the protected space.

8. The method of collecting and disseminating information as in claim 1 wherein the step of detecting a signal event further comprises detecting passage of a predetermined time period.

9. The method of collecting and disseminating information as in claim 8 further comprising measuring a parameter within the protected space.

10. The method of collecting and disseminating information as in claim 9 wherein the step of measuring a parameter within the protected space further comprises measuring a battery voltage.

11. The method of collecting and disseminating information as in claim 10 wherein the step of measuring a parameter within the protected space further comprises measuring a battery temperature.

12. The method of collecting and disseminating information as in claim 11 wherein the step of measuring a parameter within the protected space further comprises measuring a battery current.

13. The method of collecting and disseminating information as in claim 12 wherein the step of measuring a battery voltage and current further comprises calculating a performance index for display to the manager through the Internet connection.

14. The method of collecting and disseminating information as in claim 12 wherein the step of measuring a battery voltage and current further comprises calculating a discharge time remaining for display to the manager through the Internet connection.

15. The method of collecting and disseminating information as in claim 12 wherein the step of measuring a battery voltage and current further comprises calculating a depth of discharge for display to the manager through the Internet connection.

16. The method of collecting and disseminating information as in claim 12 wherein the step of measuring a battery voltage and current further comprises calculating a battery life expectancy for display to the manager through the Internet connection.

17. The method of collecting and disseminating information as in claim 1 further comprising graphing the signal event for the benefit of the manager.

18. The method of collecting and disseminating information as in claim 1 further comprising comparing a magnitude of the signal event with a threshold value and when the magnitude exceeds the threshold value sending an e-mail message to the manager.

19. An apparatus for collecting and disseminating information regarding a plurality of protected spaces comprising:

a database with a plurality of secure storage areas and subareas where each secure storage area of the plurality of secure storage areas is reserved for a respective protected space of the plurality of protected spaces and each subarea is reserved for a type of signal event received of the respective protected space;

means for detecting a signal event of the protected space;

means for coding the signal event into a packet message;

means for transferring the coded packet message to a database through an internet connection between the protected space and the database;

means for determining a type of signal event of the message packet;

means for storing the coded message packet in a secure storage area and subarea of the plurality of secure storage areas and subareas of the database that corresponds to the protected space and type of signal event under a password assigned to a manager of the protected space; and means for providing access to information of the coded message packet through an Internet connection between the manager and the database based upon the password assigned to the manager.

20. The apparatus for collecting and disseminating information as in claim 19 Further comprising means for associating a time stamp with the coded signal event.

21. The apparatus for collecting and disseminating information as in claim 19 further comprising means for associating a source indicator with the signal event.

22. The apparatus for collecting and disseminating information as in claim 19 further comprising means for receiving the password assigned to the manager from the manager of the protected space by a controller of the database.

23. The apparatus for collecting and disseminating information as in claim 19 wherein the means for receiving the password further comprises means for presenting the manager with a menu of information display options of information contained within the secure storage area.

24. The apparatus for collecting and disseminating information as in claim 19 further comprising means for defining the message event as information related to a status of an emergency power system protecting the protected space.

25. The apparatus for collecting and disseminating information as in claim 19 further comprising means for defining the message event as environmental data related to the protected space.

26. The apparatus for collecting and disseminating information as in claim 19 wherein the means for detecting a signal event further comprises means for detecting passage of a predetermined time period.

27. The apparatus for collecting and disseminating information as in claim 26 further comprising means for measuring a parameter within the protected space.

28. The apparatus for collecting and disseminating information as in claim 27 wherein the means for measuring a parameter within the protected space further comprises means for measuring a battery voltage.

29. The apparatus for collecting and disseminating information as in claim 28 wherein the means for measuring a parameter within the protected space further comprises means for measuring a battery temperature.

30. The apparatus for collecting and disseminating information as in claim 29 wherein the means for measuring a parameter within the protected space further comprises means for measuring a battery current.

31. The apparatus for collecting and disseminating information as in claim 30 wherein the means for measuring a battery voltage and current further comprises means for calculating a performance index for display to the manager through the Internet connection.

32. The apparatus for collecting and disseminating information as in claim 31 wherein the means for measuring a battery voltage and current further comprises means for calculating a discharge time remaining for display to the manager through the Internet connection.

33. The apparatus for collecting and disseminating information as in claim 31 wherein the means for measuring a battery voltage and current further comprises means for calculating a depth of discharge for display to the manager through the Internet connection.

34. The apparatus for collecting and disseminating information as in claim 31 wherein the means for measuring a battery voltage and current further comprises means for calculating a battery life expectancy for display to the manager through the Internet connection.

35. An apparatus for collecting and disseminating information regarding a plurality of protected spaces comprising:

a database with a plurality of secure storage areas and subareas where each secure storage area of the plurality of secure storage areas is reserved for a respective protected space of the plurality of protected spaces and each subarea is reserved for a type of signal event received of the respective protected space;

a sensor adapted to detect a signal event of the protected space;

code processor adapted to code the signal event into a packet message;

an Internet connection adapted to transfer the coded packet message to a database through an internet connection between the protected space and the database;

a database adapted to store the coded message packet in a secure storage area and subarea of the plurality of secure storage areas and subareas database that corresponds to the protected space and type of signal event under a password assigned to a manager of the protected space; and a web site adapted to provide access to information of the coded message packet through an Internet connection between the manager and the database based upon the password assigned to the manager.

36. The apparatus for collecting and disseminating information as in claim 35 further comprising a clock adapted to associate a time stamp with the coded signal event.

* * * * *